US005940163A

United States Patent [19]

Byrum

[11] Patent Number: 5,940,163

[45] Date of Patent: Aug. 17, 1999

[54] PHOTON COUPLED COLOR FLAT PANEL DISPLAY AND METHOD OF MANUFACTURE

[75] Inventor: Bernard W. Byrum, Perrysburg, Ohio

[73] Assignee: Electro Plasma Inc., Millbury, Ohio

[21] Appl. No.: 08/835,346

[22] Filed: Apr. 7, 1997

Related U.S. Application Data

[63] Continuation of application No. 08/277,191, Jul. 19, 1994, abandoned.

[51] Int. Cl.[6] ..... G09G 3/22

[52] U.S. Cl. ..... 351/74; 313/495; 313/484; 345/60

[58] Field of Search ..... 345/74, 75, 55, 345/47, 72, 102, 87, 88; 313/527, 541, 544, 495, 496, 497, 509, 542; 348/329; 437/167; 315/11, 491; 34/60, 65, 484

[56] References Cited

U.S. PATENT DOCUMENTS

| | | | |
|---|---|---|---|
| 3,502,928 | 3/1970 | Guyot et al. | 313/554 |
| 3,589,789 | 6/1971 | Hubert et al. . | |
| 3,810,686 | 5/1974 | Coleman . | |
| 3,814,977 | 6/1974 | Simms | 315/11 |
| 3,837,724 | 9/1974 | Haberland et al. . | |
| 4,031,552 | 6/1977 | Bosserman | 345/76 |
| 4,160,191 | 7/1979 | Hausfeld | 315/491 |
| 4,193,666 | 3/1980 | Cojan | 345/76 |
| 4,195,892 | 4/1980 | Riley et al. . | |
| 4,427,479 | 1/1984 | Glaser et al. | 156/286 |
| 4,517,489 | 5/1985 | Glock et al. | 313/422 |
| 4,526,632 | 7/1985 | Nishizawa et al. | 437/167 |
| 4,531,122 | 7/1985 | Redfield | 345/74 |
| 4,577,133 | 3/1986 | Wilson | 313/103 CM |
| 4,714,956 | 12/1987 | Yin | 348/777 |
| 4,896,035 | 1/1990 | Mahoney et al. | 313/542 |
| 4,978,952 | 12/1990 | Irwin | 345/102 |
| 5,029,320 | 7/1991 | Kido et al. | 313/509 |
| 5,104,343 | 4/1992 | Maragishi et al. | 445/25 |
| 5,116,271 | 5/1992 | Arimoto | 445/24 |
| 5,121,233 | 6/1992 | Spencer et al. | 345/102 |
| 5,136,169 | 8/1992 | Smith et al. | 250/491.1 |
| 5,209,688 | 5/1993 | Nishigaki et al. . | |
| 5,266,530 | 11/1993 | Bagley et al. | 437/228 |
| 5,268,570 | 12/1993 | Kim | 313/527 |
| 5,278,544 | 1/1994 | Leroux | 345/74 |
| 5,300,862 | 4/1994 | Parker et al. | 345/74 |
| 5,436,742 | 7/1995 | Tanaka et al. | 345/95 |
| 5,543,862 | 8/1996 | Culkin | 348/739 |

OTHER PUBLICATIONS 47.5: Late–News Paper: Field–Emission Displays Based on Diamond Thin Films; N. Kumar et al.; SID 93 Digest, pp. 1009 & 1011.

The Semiconductor Field–Emission Photocathode; Schroder et al.; IEEE Transactions on Electron Devices, Dec. 1974, pp. 785–798.

Engstrom, Ralph W., Dr., *Photomultiplier Handbook Theory Design Application*, 1980, p. 3.

Photocathode Displays, Brad Culkin, Information Display Aug. 1997, pp. 14–17.

*Primary Examiner*—Dennis-Doon Chow

*Attorney, Agent, or Firm*—MacMillan, Sobanski & Todd, LLC

[57] ABSTRACT

A multi-color flat panel display of individually manufactured components operatively assembled to produce a multi-color image from a monochromatic source, the individually manufactured components include a color output assembly for converting a photon pattern produced by the monochromatic source to a corresponding electron pattern for excitation of color phosphors to display a corresponding optical image in color; and an optical collimator for preventing cross-talk between input section pixels of the monochromatic source and unassociated output section pixels of the color output assembly.

20 Claims, 3 Drawing Sheets

PHOTON COUPLED COLOR FLAT PANEL DISPLAY AND METHOD OF MANUFACTURE

This application is a continuation of application Ser. No. 08/277,191 filed Jul. 19, 1994, now abandoned.

FIELD OF THE INVENTION

This invention relates to a photon coupled color flat panel display and method of manufacture. More particularly, this invention relates to a full color, high resolution capable flat panel display device which is coupled to an electronically addressable source of monochrome input.

BACKGROUND OF THE INVENTION

Flat panel display technology has been involved in a worldwide effort to add color to flat panel display devices. One of the most successful attempts at this has been Active Matrix Liquid Crystal Displays (AMLCD). However, AMLCD has not been able to extend its technology to large displays because of yield problems in sizes 14 inch diagonal and larger.

Another flat panel technology, ac Plasma Display Panels (ACPDP) is readily extended to large sizes but has significant penalties when phosphors are added to its interior structure.

A number of literature references have described technology which attempts to duplicate some properties of the cathode ray tube (CRT) in a flat panel design. For example, U.S. Pat. No. 4,577,133 to Wilson describes the use of a patterned cold cathode which is electrically addressed. The same patent depends on the use of an internal electron multiplier to gain sufficient electron flow to meaningfully excite the phosphors. The use of a multichannel plate electron multiplier (MCP) complicates and makes the resulting structure expensive when applied on a large scale. Moreover, additional problems arise in manufacturing due to the multiple process steps necessary to form the individual cold cathode emitters. Accordingly, it is readily recognized that simple processes are desired when transferred to full scale manufacturing operations.

Field emission from microtips and thin diamond films has also been described in the literature as it applies to flat panel displays. Microtips require multiple step processes to fabricate and provide problems when applied to large areas. Moreover, simple diamond films do not have a current control feature as do the microtips and are subject to local high emission which can destroy the local film due to heating. Simple diamond films require patterning of the film and the underlying electrodes in order to isolate the individual cell site. Furthermore, the microtip and the diamond film require scanning which reduces light output intensity as the display size is increased.

The present invention is intended to address the problems of the prior art by including current control by requiring photon stimulated emission similar to a photo transistor. The fields for photo stimulated field emission are less than in a simple field emission case. In addition, the photo stimulated field emitter film does not require patterning since the light input provides the pattern.

Accordingly, an object of the present invention is to provide a large full color flat panel display with high resolution. Another object is to provide a photon coupled flat panel display so that the color structures normally found on the interior are actually exterior to a conventional monochrome flat panel display. A further object of the invention is to provide a non-patterned photo electron emitter which converts the light input pattern from any suitable monochromatic source to an electron pattern which is used to excite color phosphors. An additional object of the present invention is to provide a large full color flat panel display with high resolution that is economical to manufacture. Yet another object of the present invention is to utilize field assisted photo electron emission to provide the equivalent of a three terminal or transistor like action within the non-patterned electron emitter.

SUMMARY OF THE INVENTION

Briefly, according to this invention, there is provided a multi-color flat panel display. The display includes individually manufactured components operatively assembled to produce a multi-color image from a monochromatic source. The individually manufactured components include a color output assembly and an optical collimator. The color output assembly converts a photon pattern produced by the monochromatic source to a corresponding electron pattern for excitation of color phosphors to display a corresponding optical image in color. The optical collimator prevents cross-talk between input section pixels of the monochromatic source and unassociated output section pixels of the color output assembly.

BRIEF DESCRIPTION OF THE DRAWINGS

Further features and other objects and advantages of this invention will become clear from the following detailed description made with reference to the drawings in which.

DESCRIPTION OF THE PREFERRED EMBODIMENTS

Figure 1:
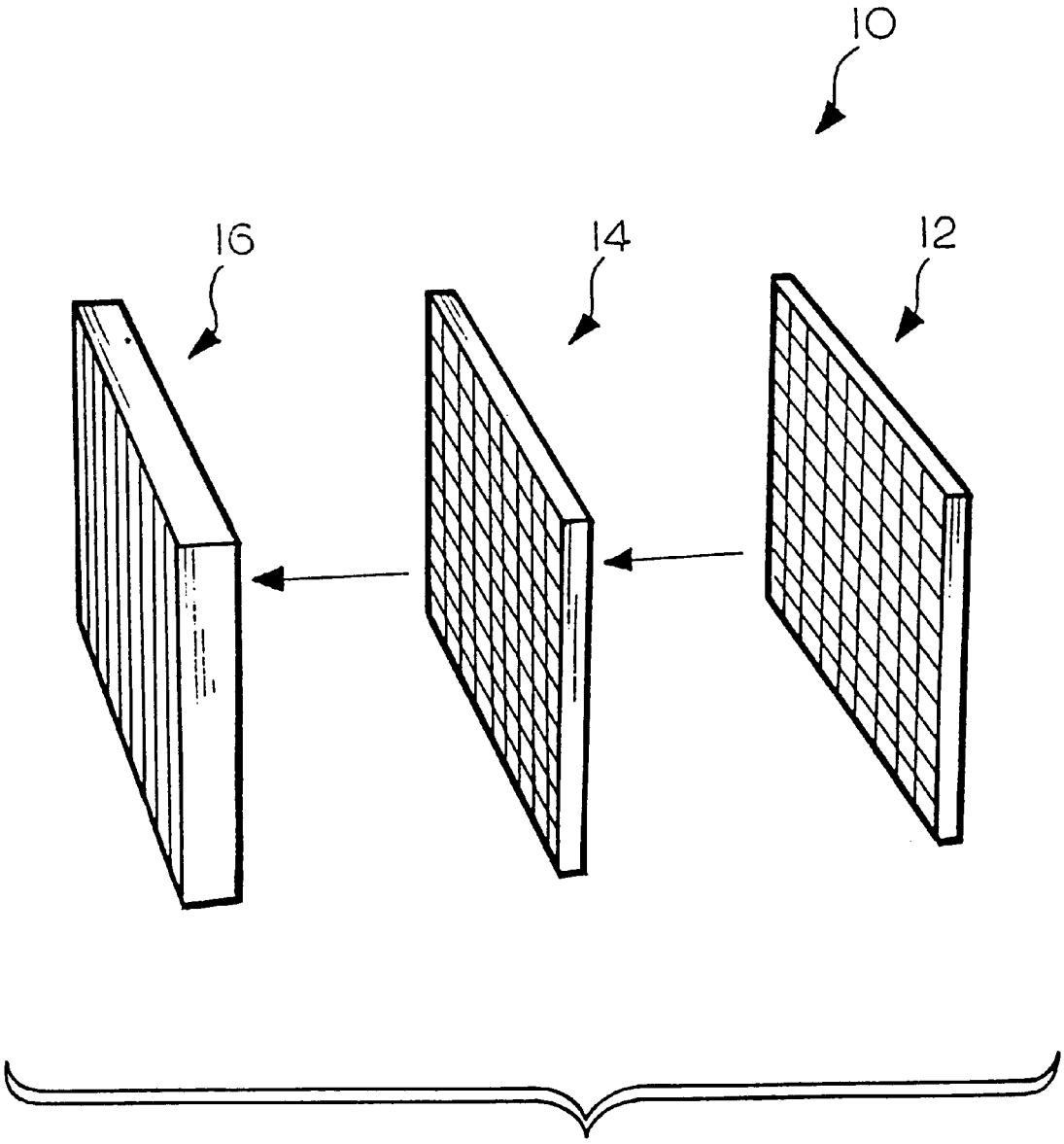
FIG. 1 is an exploded perspective view of a flat panel display in accordance with the present invention.

In the following description, like reference characters designate like or corresponding parts. Also, in the following description, it is to be understood that such terms as "forward", "rearward", "upward", "downward" and similar terms of position and direction as used hereinafter refer to the illustrations in the drawings and are used for convenience in description and reference. In addition, for purposes of clarity and conciseness, certain proportions and details of construction may have been exaggerated or may not have been provided in view of such details being conventional and well within the skill of the art once the invention is disclosed and explained. For example, control circuits and electric conductor elements which may be screened onto the glass pane(s) and otherwise appropriately connected to the control circuits for the pane(s) have not been described or shown in view of such connections and circuits being well known and within the skill of the art.

Referring to the drawings, FIG. 1 illustrates a flat panel display 10 for displaying an optical image in color. The flat panel display 10 includes separately manufactured components which may be operatively assembled to form the flat panel display. The separately manufactured components of FIG. 1 include a monochrome source such as a monochrome plasma display panel 12, optical collimator 14 and color output assembly 16. The separately manufactured components are assembled using conventional optically transparent epoxy or silicon based adhesives. It will be appreciated that the separate manufacture of the components of the flat panel color display 10 avoids manufacturing problems such as those encountered when attempting to integrate multi-color phosphors and barriers into a monochrome ac plasma display panel.

As shown in the figures, the monochrome source is an ac plasma display panel (PDP) 12. The ac plasma display panel is of a conventional design and well known in the art. Generally, the plasma display panel 12 comprises two spaced apart flat plates of glass approximately ⅛–¼ inch thick. Deposited on the inside face of the glass plates are sets of parallel conductors at right angles to each other. The space between the plates is hermetically sealed and filled with a gas such as neon. Each intersection of two conductors defines a single cell that can be energized to produce a gas discharge forming one input section pixel of the display panel 12 containing gray scale and color information. The color information is spatially arranged to match the phosphor arrangement of the color output assembly 16 as more fully described herein. It will be appreciated that although the present invention finds particular application with reference to an ac monochrome plasma display panel 12 any suitable light source may be used to provide a photo emission pattern.

Figure 2:
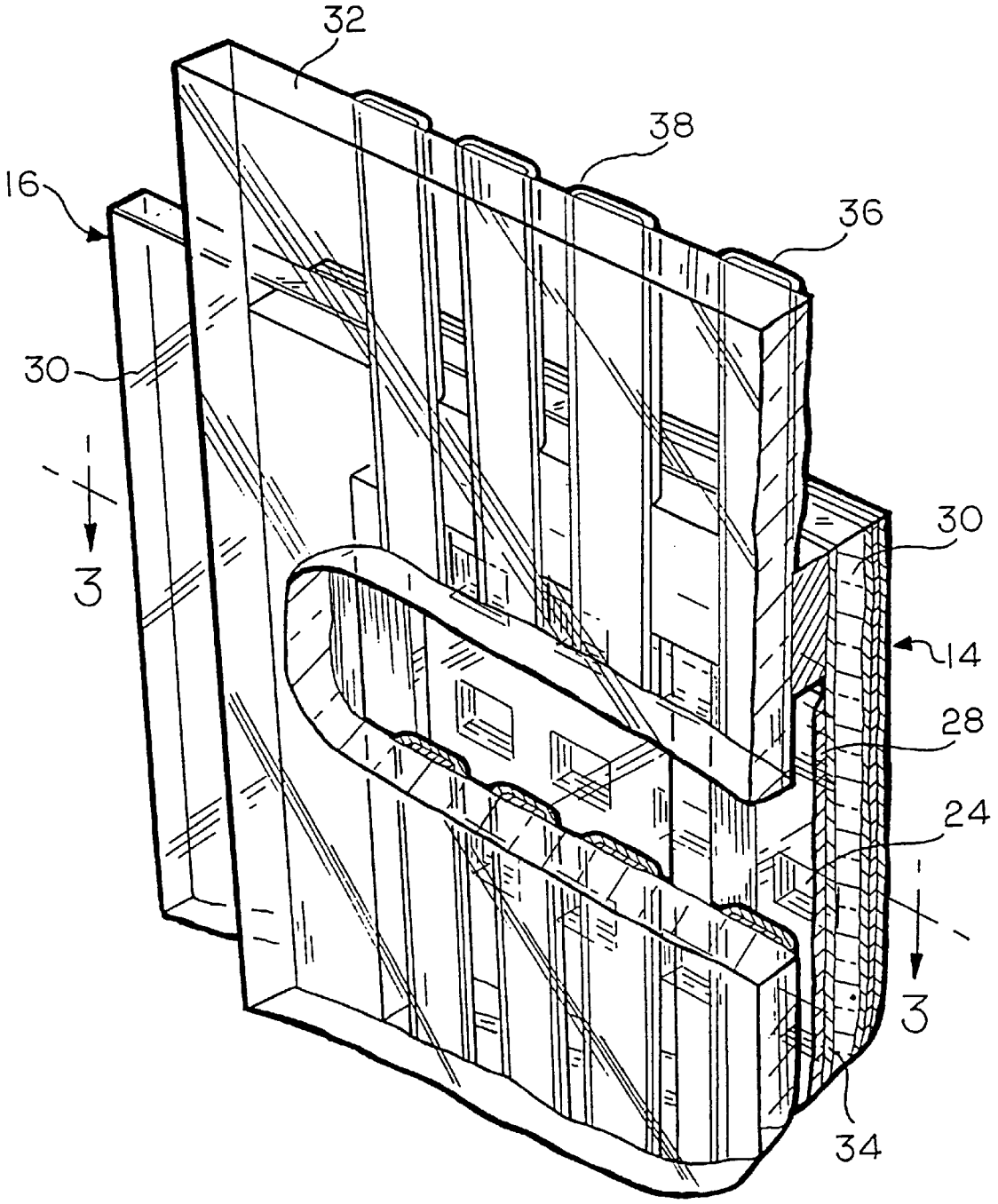
FIG. 2 is a perspective view of the color output device and optical collimator of the flat panel display of FIG. 1.
Figure 3:
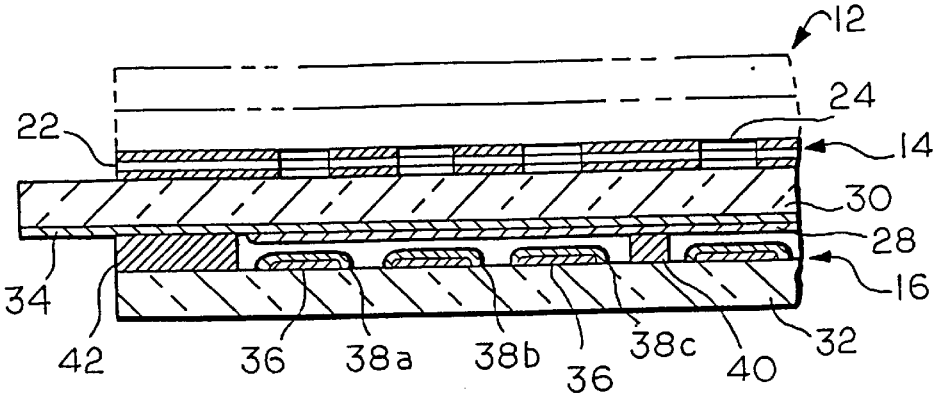
FIG. 3 is a cross sectional view of the flat panel display of FIG. 1.
Figure 4:
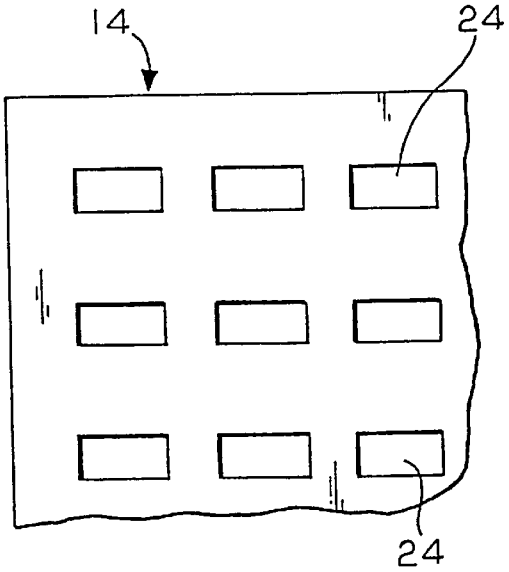
FIG. 4 is a partial front view of an optical collimator in accordance with the present invention.
Figure 5:
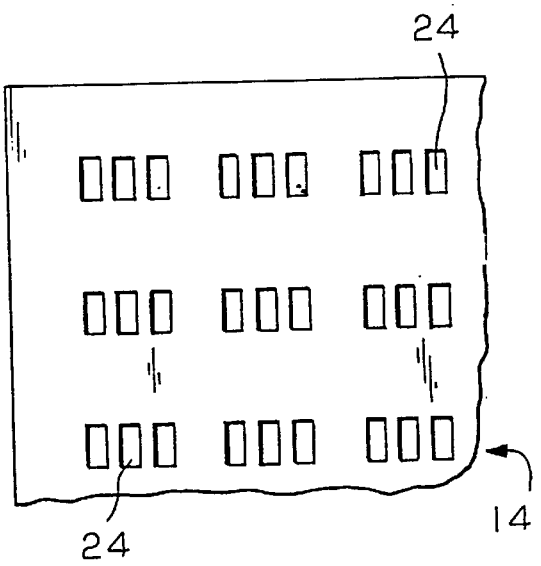
FIG. 5 is a partial front view of an alternate embodiment of an optical collimator in accordance with the present invention.

Referring to FIGS. 2 and 3, the optical collimator 14 of the flat panel color display 10 includes one or more opaque plates 22 with clear etched apertures 24 which are aligned with each input section pixel of the monochrome flat plasma display panel 12. The opaque plates 22 of the collimator 14 may be formed of a suitable metal or other material to prevent cross-talk between input section pixels of the monochrome plasma display panel 12 and unassociated output section pixels of the color output assembly 16. The optical collimator 14 is spatially arranged to match the phosphor arrangement 38 of the color output assembly 16 and the input section pixels of the ac plasma display panel 12. As shown in FIG. 3, the three separate color pixels of multicolor phosphors 38*a*, 38*b* and 38*c* are addressed by a common monochrome input section pixel from the ac plasma display panel through time phasing the three color fields. This arrangement allows for the use of a common clear etched aperture 24 as opposed to three separate apertures. The optical collimator 14 may be formed of any number of opaque plates 22 for a desired thickness, however, typically, the total thickness of the optical collimator is no more than ⅛ inch thick. It will be appreciated that the optical collimator 14 may also be formed of alternate clear and opaque bars in both vertical and horizontal orientations to form a matrix of transmissive spots or the optical collimator may include fiber optics to form a matrix of transmissive spots.

The color output assembly 16 of the flat panel color display 10 includes a glass plate substrate 30 and a phosphor glass plate 32. The glass plate 30 and 32 is transmissive to light and is of a uniform thickness. The glass may contain $SiO_2$, $Al_2O_3$, $MgO_2$ and CaO as the main ingredients and $Na_2O$, $K_2O$, PbO, $B_2O_3$ and the like as accessory ingredients. To facilitate external electrical connections to an appropriate driving circuitry and power supply as known in the art the glass plate substrate 30 is wider than the phosphor glass plate 32 and the phosphor glass plate is longer than the glass plate substrate such that the glass plate substrate and the phosphor glass plate overlap in the lengthwise dimension and in the widthwise dimension.

The inward side of the glass plate substrate 30 includes a continuous thin transparent film 34 of a conductive material which also overlaps the phosphor glass plate 32. As used herein the term "continuous" with respect to the film 34 refers to the film being nonpatterned. The conductive material may be ITO (indium-tin-oxide) transparent electrodes (an electrode formed of tin doped indium oxide) or the like. Similarly, the inward side of the phosphor glass plate 32 includes thin parallel strips 36 of a transparent film of a conductive material of ITO or the like. Each thin strip 36 of conductive material functions as an anode electrode to collect electrons and includes a phosphor material coating 38. The phosphor material coating is of a standard electron excited phosphor material of a type well known in the art. For a full color display, multi-color phosphors 38*a*, 38*b* and 38*c* such as red, green and blue phosphors are oriented in groups of three and applied in bands or dots at the appropriate pixel locations to match the monochrome input light pattern pixels.

The glass plate substrate 30 and the phosphor glass plate 32 are assembled in a spaced apart parallel relationship. Although the exact dimensions of the color output assembly 16 may vary as desired, typically, the color output assembly may be ¼ inch thick or less. A vacuum is established between the glass plate substrate 30 and the phosphor glass plate 32, the plates are hermetically sealed with a conventional glass seal 42 or metallic seal such as indium or the like. The space or gap between the glass plate substrate 30 and the phosphor glass plate 32 is approximately 25–100 microns. The gap is maintained by spacers or ribs 40 of an insulating material such as glass or ceramic material and the like which separate the multi-color phosphors 38*a*, 38*b* and 38*c* either vertically or horizontally, into groups of three, one strip for each primary color. For a full-color display, red, green and blue phosphors 38*a*, 38*b* and 38*c* are oriented in groups of three and applied in bands or dots at the appropriate pixel locations as shown in the figures. The resolution of the full color flat panel display 10 is determined by the number of pixels per unit area.

In accordance with the present invention, the glass plate substrate 30 further includes a field assisted photo electron emitter film 28 which extends as a continuous film within the perimeter defined by the seal 42. The space between the photo electron emitter film 28 and the phosphor strips 38*a*, 38*b* and 38*c* is approximately 25–100 microns. The material of the photo electron emitter film 28 is critical to the successful practice of the present invention. The photo electron emitter film 28 has a band gap between about 1.1 eV (electron volt) and 2 eV, and preferably between about 1.25 eV and 2 eV. The material band gap should be limited on the low end to about 1.1 eV, and preferably 1.25 eV to minimize response to infrared radiation. Similarly, on the high end, the band gap upper limit is determined by the light input from the monochrome flat panel. For example, for an ac plasma display panel, the band gap upper limit is about 2 eV. Suitable photo electron emitter films 28 include Group IIb–VIb compounds, Group IIIb–Vb compounds and other suitable known photosensitive materials having an acceptable band gap. It will be appreciated that the electron affinity of the material is not as critical since the field effect is used to negate this energy requirement. The thickness of the photo electron emitter film 28 is selected as a function of the wavelength of light to optimize the response to the wavelength of light emitted by the monochrome flat panel section. Thicknesses from about 500 angstrom units to about 10,000 angstrom units are believed acceptable for the photo electron emitter film. Suitable photo electron emitter films 28 that meet the band gap criteria include Si, CdTe, GaAs, InP and $K_3Sb$ and other alkali antimonide or multi-alkali antimonide and the like. The eventual selection of an optimum photo electron emitter film may be determined by such other considerations as manufacturing limitations, light source, size of flat panel display, cost and the like.

In an alternate embodiment, the photo electron emitter film 28 may be treated with cesium or other electron affinity reducing material such that simple photo electron emission occurs without the necessity of field enhanced emission. The photo electron emitter film 28 may be deposited on the glass plate substrate 30 using techniques well known in the art such as pulsed laser physical vapor deposition, rf sputtering and the like.

The color output assembly 16 functions to couple incoming light patterns, i.e., photons, from the monochrome plasma display panel 12 which are directed through the optical collimator 14 to the photo electron emitter film 28. The photo electron emitter film 28, used in the transmission mode, converts the photon input from the plasma display panel 12 to a corresponding electron pattern, i.e., receives photons through the glass substrate and emits a corresponding pattern of electrons into the vacuum on the opposite side of the glass substrate proportional to the photon intensity. The electrons strike the phosphor strips 38*a*, 38*b* and 38*c* causing the phosphor strips to fluoresce or give off light corresponding to the optical image appearing on the monochromatic display.

It will be appreciated that it is a feature of the present invention that the color flat panel display 10 may be manufactured as separate parts or components which are then cooperatively optically coupled together wherein communication between the distinct parts or components is accomplished by photons. Accordingly, the color output is not scanned as in prior field emission displays but provides simultaneous real time output in association with the monochromatic source. It will be further appreciated that although the invention was primarily developed in connection with large high resolution color flat panel displays finding application in computer assisted design displays, displays for air traffic controllers, multiple page displays for programmers and the like, it will be readily apparent that the flat panel display may find application in most any instance where a large panel display may be required or is beneficial.

Having described presently preferred embodiments of the invention, it is to be understood that it may be otherwise embodied within the scope of the appended claims.

What is claimed is:

1. A multi-color flat panel display capable of providing a multi-color image that corresponds to an optical image produced from a monochromatic source, said multi-color flat panel display comprising:

(a) a color output assembly including:

a glass plate substrate located nearest the monochromatic source;

a continuous film of conductive material formed on an inward side of said glass plate substrate;

a field assisted photo electron emitter film formed on said continuous film of conductive material for providing field assisted photo emission, said field assisted photo electron emitter film having a band gap between about 1.1 eV and 2 eV;

a phosphor glass plate;

parallel strips of conductive material formed on an inward side of said phosphor glass plate; and a coating of phosphor material formed on said parallel strips of conductive material, wherein said phosphor glass plate is hermetically sealed in a spaced apart, parallel relationship with said glass plate such that the space between said field assisted photo electron emitter film and said phosphor material is approximately 25–100 microns; and (b) an optical collimator positioned between the glass plate substrate and the monochromatic source for preventing cross-talk between input section pixels of the monochromatic source and unassociated output section pixels of said color output assembly, wherein a pattern of photons corresponding to an optical image are emitted by the monochromatic source and directed through said optical collimator are received by the field assisted photo electron emitter film of said color output assembly, and wherein a corresponding pattern of electrons having a flux proportional to an intensity of the pattern of photons are emitted by the field assisted photo electron emitter film and strike the phosphor strips, thereby causing the phosphor strips to display an optical image in color that corresponds to the optical image of the monochromatic source.

2. The multi-color flat panel display of claim 1 wherein said optical collimator is formed of a plurality of plates that form a matrix of transmissive spots passing gray scale and color information and spatially arranged to match the phosphor arrangement of the color output assembly.

3. The multi-color flat panel display of claim 2 wherein said transmissive spots include a common monochrome pixel which addresses three separate color pixels of the color output assembly through time phasing the three color fields.

4. The multi-color flat panel display of claim 1 wherein said optical collimator is formed of alternate clear and opaque bars in both vertical and horizontal orientations to form a matrix of transmissive spots passing gray scale and color information and is spatially arranged to match the phosphor arrangement of the color output assembly.

5. The multi-color flat panel display of claim 1 wherein said optical collimator is formed of fiber optics.

6. The multi-color flat panel display of claim 1 wherein the field assisted photo electron emitter film is a thin film used in the transmission mode.

7. The multi-color flat panel display of claim 6 wherein the field assisted photon electron emitter film is a continuous thin film.

8. The multi-color flat panel display of claim 6 wherein the thin film has a band gap of between about 1.1 eV and 2 eV.

9. The multi-color flat panel display of claim 6 wherein the thin film has a band gap of between about 1.25 eV and 2 eV.

10. The multi-color flat panel display of claim 6 wherein the field assisted photon electron emitter film is a continuous film selected from the group consisting of Si, CdTe, GaAs, $K_3Sb$, alkali antimonide and multi-alkali antimonide.

11. The multi-color flat panel display of claim 10 wherein said optical collimator is formed of a plurality of plates that form a matrix of transmissive spots passing gray scale and color information and spatially arranged to match the phosphor arrangement of the color output assembly.

12. The multi-color flat panel display of claim 11 wherein said transmissive spot includes a common monochrome pixel which addresses three separate color pixels of the color output assembly through time phasing the three color fields.

13. The multi-color flat panel display of claim 10 wherein said optical collimator is formed of alternate clear and opaque bars in both vertical and horizontal orientations to form a matrix of transmissive spots passing gray scale and color information and is spatially arranged to match the phosphor arrangement of the color output assembly.

14. The multi-color flat panel display of claim 10 wherein said optical collimator is formed of fiber optics.

15. The multi-color flat panel display of claim 10 wherein the film is treated with an electron affinity reducing material such that simple photo electron emission occurs without the use of field assisted emission.

16. The multi-color flat panel display of claim 10 wherein the film is treated with cesium such that simple photo electron emission occurs without the use of field assisted emission.

17. The multi-color flat panel display of claim 6 wherein the field assisted photon electron emitter film is selected from the group consisting of Group IIb and VIb compounds.

18. The multi-color flat panel display of claim 6 wherein the field assisted photon electron emitter is selected from the group consisting of Group IIIb and Vb compounds.

19. A multi-color flat panel display capable of providing a multi-color image that corresponds to an optical image produced from a monochromatic source, said multi-color flat panel display comprising:

(a) a color output assembly including:

a glass plate substrate, an inward side of said glass plate substrate having a continuous thin film of conductive material, and a field assisted photo electron emitter film formed on the thin transparent film of conductive material for providing field assisted photo emission, said field assisted photoelectron emitter film having a band gap between about 1.1 eV and 2 eV, and a spaced parallel phosphor glass plate hermetically sealed to said glass plate with a seal, an inward side of said phosphor glass plate including parallel strips of conductive material and a phosphor material coating formed on the parallel strips of conductive material, wherein said field assisted photo electron emitter film is spaced from said phosphor material from about 25–100 microns; and (b) an optical collimator for preventing cross-talk between input section pixels of the monochromatic source and unassociated output section pixels of said color output assembly, wherein the field assisted photo electron emitter film is selected of a material such that the electrons emitted by the field assisted photo electron emitter film strike the phosphor material coating and correspond to the photons emitted by the monochromatic source, thereby converting a monochrome optical image to a corresponding optical image in color.

20. A multi-color flat panel display capable of providing a multi-color image that corresponds to an optical image from a monochromatic source without amplification, said multi-color flat panel display comprising:

(a) a color output assembly including:

a glass plate substrate, an inward side of said glass plate substrate having a continuous thin transparent film of conductive material, and a field assisted photo electron emitter film formed on the thin transparent film of conductive material for providing field assisted photo emission, said field assisted photo electron emitter film having a band gap between about 1.1 eV and 2 eV: and a spaced parallel phosphor glass plate hermetically sealed to said glass plate with a seal, an inward side of said phosphor glass plate including parallel strips of conductive material and a phosphor material coating formed on the parallel strips of conductive material, wherein said field assisted photo electron emitter film is spaced from said phosphor material approximately 25–100 microns; and (b) an optical collimator for preventing cross-talk between input section pixels of the monochromatic source and unassociated output section pixels of said color output assembly, wherein the field assisted photo electron emitter film emits a pattern of electrons corresponding to the photon pattern and proportional to the photon intensity emitted by the monochromatic source to couple the incoming photon pattern to the phosphors by the emitted electrons thereby converting a monochrome optical image to a corresponding optical image in color without amplification.

* * * * *